US012618601B2

(12) United States Patent
Bao et al.

(10) Patent No.: US 12,618,601 B2
(45) Date of Patent: May 5, 2026

(54) ICE DISPENSING DEVICE, REFRIGERATOR DOOR ASSEMBLY, AND REFRIGERATOR

(71) Applicants: QINGDAO HAIER REFRIGERATOR CO., LTD, Qingdao (CN); HAIER SMART HOME CO., LTD., Qingdao (CN)

(72) Inventors: Maozeng Bao, Qingdao (CN); Yanqing Zhang, Qingdao (CN); Qihai Du, Qingdao (CN); Guoliang Mou, Qingdao (CN)

(73) Assignees: QINGDAO HAIER REFRIGERATOR CO., LTD, Qingdao (CN); HAIER SMART HOME CO., LTD., Qingdao (CN)

( * ) Notice: Subject to any disclaimer, the term of this patent is extended or adjusted under 35 U.S.C. 154(b) by 85 days.

(21) Appl. No.: 18/693,791

(22) PCT Filed: Sep. 20, 2022

(86) PCT No.: PCT/CN2022/119932
§ 371 (c)(1),
(2) Date: Mar. 20, 2024

(87) PCT Pub. No.: WO2023/045929
PCT Pub. Date: Mar. 30, 2023

(65) Prior Publication Data

US 2026/0118034 A1 Apr. 30, 2026

(30) Foreign Application Priority Data

Sep. 23, 2021 (CN) ..... 202111111813.4

(51) Int. Cl.
*F25C 5/20* (2018.01)
*F25D 23/02* (2006.01)

(52) U.S. Cl.
CPC ..... *F25C 5/22* (2018.01); *F25D 23/028* (2013.01)

(58) Field of Classification Search
CPC ..... F25C 5/22; F25D 23/028; F25D 23/02
See application file for complete search history.

(56) References Cited

U.S. PATENT DOCUMENTS

2012/0025418 A1 2/2012 Lee et al.
2013/0146612 A1* 6/2013 Sanchez ..... B67D 1/0889 222/113
2018/0238600 A1* 8/2018 Lee ..... F25D 17/06

FOREIGN PATENT DOCUMENTS

CN 106196797 A 12/2016
CN 107024050 A 8/2017
(Continued)

OTHER PUBLICATIONS

KR-100621108-B1 translation.*

*Primary Examiner* — Elizabeth J Martin
(74) *Attorney, Agent, or Firm* — MUNCY, GEISSLER, OLDS & LOWE, P.C.

(57) ABSTRACT

An ice dispensing device includes an ice dispensing channel, which has an ice dispensing outlet, a cover assembly for opening and closing the ice dispensing outlet, a driving device that connects to the driving shaft of the cover assembly to drive the rotation of the cover assembly. The cover assembly includes a bracket and a sealing cover, and the bracket is connected to the sealing cover via a connecting shaft. The sealing cover is capable of swinging around the axis of the connecting shaft, and an elastic support element is provided between the sealing cover and the bracket. A contact position of the elastic support element with the sealing cover is located on the side of the sealing cover that
(Continued)

is away from the driving shaft, with the connecting shaft positioned between the driving shaft and the contact position.

9 Claims, 7 Drawing Sheets

(56) References Cited

FOREIGN PATENT DOCUMENTS

| | | | | |
|---|---|---|---|---|
| CN | 209819996 | U | 12/2019 | |
| CN | 111854255 | A | 10/2020 | |
| CN | 111854260 | A | 10/2020 | |
| CN | 112129035 | A | 12/2020 | |
| CN | 112444028 | A | 3/2021 | |
| KR | 100621108 | B1 * | 9/2006 | ..... F25C 5/22 |

* cited by examiner

ICE DISPENSING DEVICE, REFRIGERATOR DOOR ASSEMBLY, AND REFRIGERATOR

CROSS-REFERENCE TO RELATED APPLICATIONS

The present application is a national phase entry of International Application No. PCT/CN2022/119932, filed Sep. 20, 2022, which claims priority to Chinese Patent Application No. 202111111813.4, filed Sep. 23, 2021, which are incorporated herein by reference in their entirety.

TECHNICAL FIELD OF THE PRESENT INVENTION

The present application refers to the field of Household appliances, specifically to an ice dispensing device, a refrigerator door assembly, and a refrigerator.

BACKGROUND OF THE PRESENT INVENTION

In current home life, refrigerators have become indispensable household appliances, integrating an increasing number of functions. Some refrigerators are equipped with ice-making devices, to facilitate users in taking out ice, a dispenser is often installed on the refrigerator door. The refrigerator is equipped with an ice storage bin inside, and the ice in the storage bin is transported to the dispenser through an ice delivery channel. Ice can be dispensed from the ice dispenser's outlet. This allows users to take out the ice from the ice storage bin without opening the refrigerator door, using the dispenser.

To prevent the leakage of cold air from the refrigerator's interior, the ice dispensing outlet is usually sealed with a sealing cover. However, the sealing cover can easily become misaligned during closure, creating gaps that lead to air leakage.

Reference to any prior art in the specification is not, and should not be taken as, an acknowledgment or any form of suggestion that this prior art forms part of the common general knowledge in US or any other jurisdiction or that this prior art could reasonably be expected to be understood and regarded as relevant by a person skilled in the art.

SUMMARY OF THE PRESENT INVENTION

To address the above problems, the present application provides an ice dispensing device, a refrigerator door, and a refrigerator wherein the sealing cover can swing around a connecting shaft, with an elastic support rib provided to support the sealing cover.

The present application provides an ice dispensing device, comprising:

an ice dispensing channel, which has an ice dispensing outlet;

a cover assembly, for opening and closing the ice dispensing outlet;

a driving device, which connects to the driving shaft of the cover assembly to drive the rotation of the cover assembly;

the cover assembly comprises a bracket and a sealing cover, wherein the bracket is connected to the sealing cover via a connecting shaft;

characterized in that, the sealing cover is capable of swinging around the axis of the connecting shaft, and an elastic support element is provided between the sealing cover and the bracket, a contact position of the elastic support element with the sealing cover is located on a side of the sealing cover that is away from the driving shaft, with the connecting shaft positioned between the driving shaft and the contact position.

As a further improvement of an embodiment of the present application, characterized in that a center of gravity of the sealing cover is located between the contact position and the driving shaft.

As a further improvement of an embodiment of the present application, characterized in that one end of the bracket is connected to the driving device, and the elastic support element comprises an elastic support rib located on a free end side of the bracket, the free end of the elastic support rib is supported on the sealing cover.

As a further improvement of an embodiment of the present application, characterized in that the elastic support rib extends from the free end of the bracket towards a side close to the driving shaft.

As a further improvement of an embodiment of the present application, characterized in that the connecting shaft is provided on one of the bracket and the sealing cover, and the connecting shaft contacts a point on an other of the bracket and the sealing cover.

As a further improvement of an embodiment of the present application, characterized in that the sealing cover is capable of moving along an axial direction of the connecting shaft.

As a further improvement of an embodiment of the present application, characterized in that the other of the bracket and the sealing cover is provided with a support rib set at an angle to the connecting shaft, the connecting shaft is supported by the support rib, and the connecting shaft is capable of swinging around the support rib.

As a further improvement of an embodiment of the present application, characterized in that the connecting shaft is perpendicular to the support rib, and a contact point between the connecting shaft and the support rib is located on a central axis of the sealing cover.

The present application provides a refrigerator door assembly, comprising a door and a dispenser provided on the door, wherein the door comprises a door shell and a door liner filled with insulating material between the door shell and the door liner, characterized in that the dispenser comprises the ice dispensing device according to claim 1, and the ice dispensing channel penetrates the door.

The present application provides a refrigerator, comprising a cabinet and a door for opening and closing the cabinet, wherein an ice-making device is set inside the refrigerator, and an ice storage bucket and a dispenser are set on the door, the ice storage bucket is communicated with the dispenser, characterized in that the dispenser comprises the ice dispensing device according to claim 1, and the ice dispensing channel penetrates the door and communicates with the ice storage bucket.

This design allows the sealing cover a certain degree of freedom to adjust its position automatically during closure. At the same time, the ice dispenser is equipped with elastic support components to support the sealing cover and prevent the sealing cover from deviating under the influence of gravity. this ice dispenser provides excellent sealing effectiveness.

As used herein, except where the context clearly requires otherwise, the term "comprise" and variations of the term, such as "comprising", "comprises" and "comprised", are not intended to exclude further features, components, integers or steps.

DETAILED DESCRIPTION OF THE PRESENT INVENTION

To facilitate a clear understanding of the technical solutions in the embodiments of the present application, the following description is provided in conjunction with the drawings of the embodiments of the present application. It is evident that the described embodiments are only part of the embodiments of the present application, rather than all of them. Based on the embodiments of the present application, all other embodiments obtained by those skilled in the art without creative efforts shall fall within the protection scope of the present application.

Figure 1:
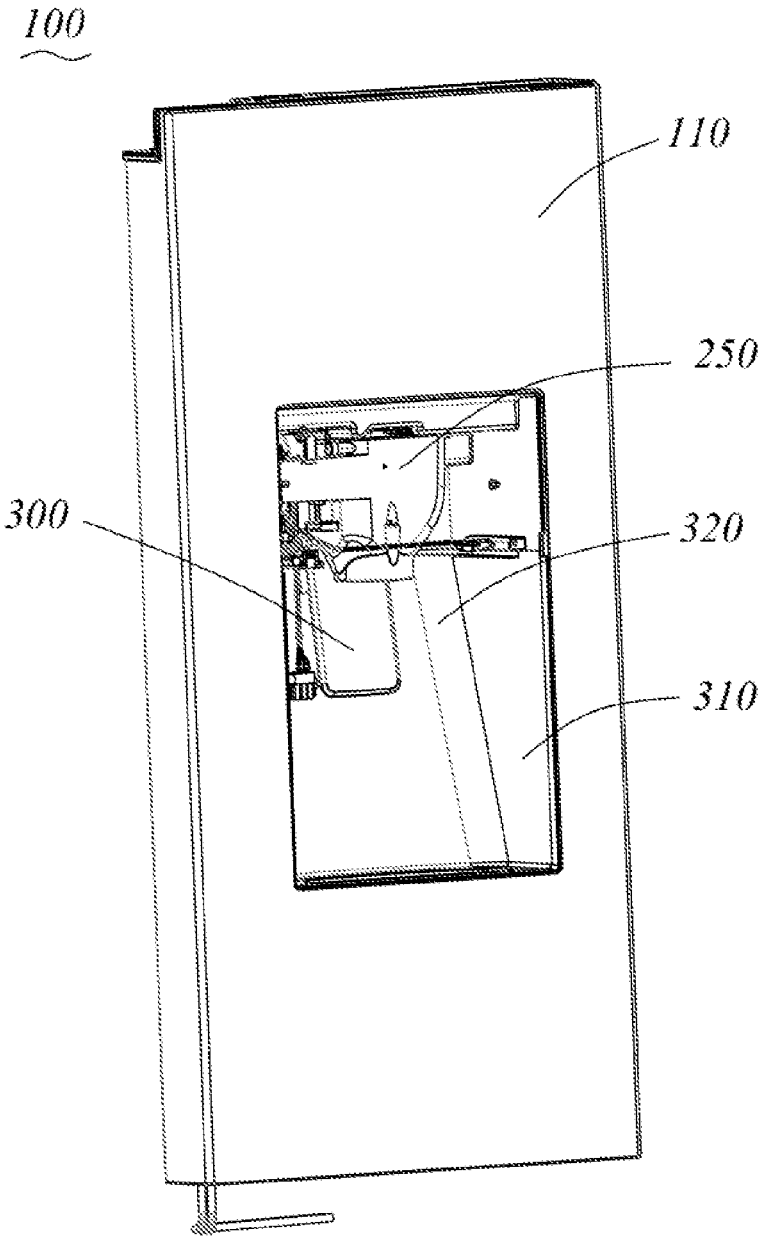
FIG. 1 is a schematic three-dimensional view of a refrigerator door assembly according to an embodiment of the application.
Figure 2:
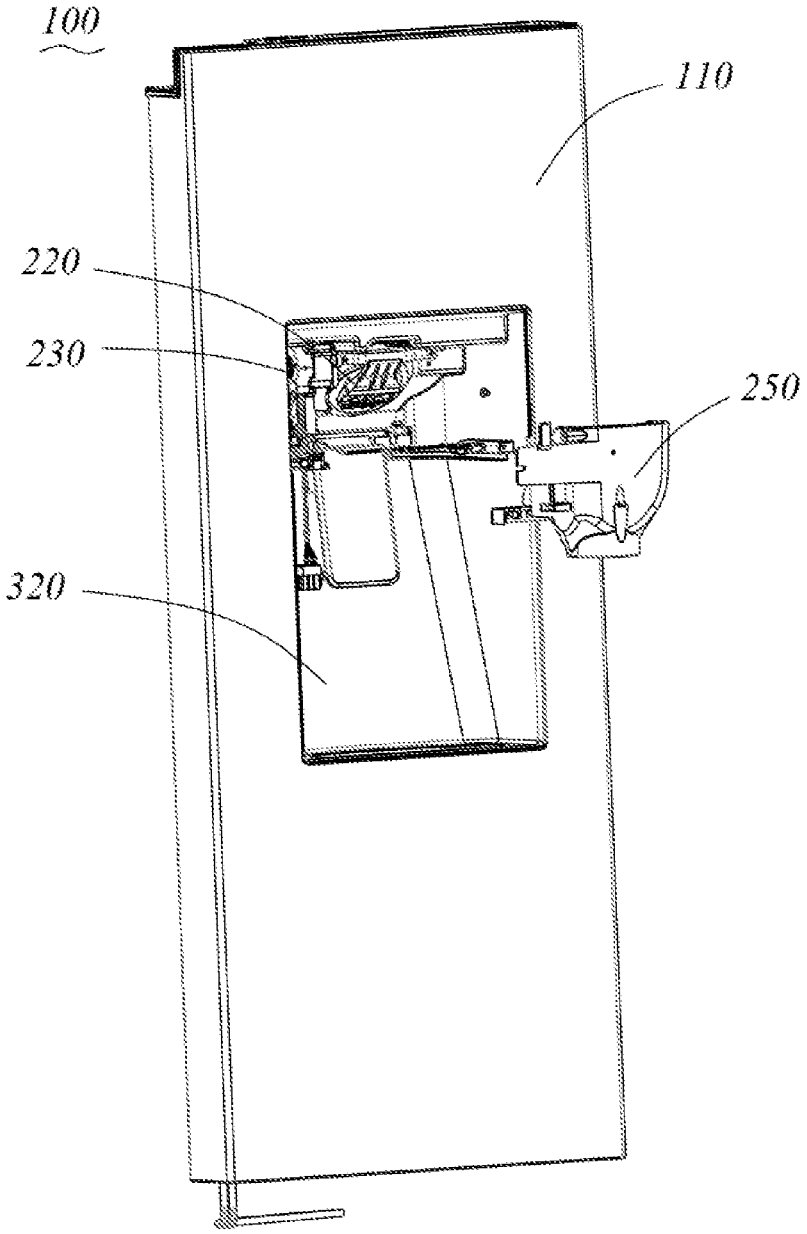
FIG. 2 is an exploded schematic view of the refrigerator door assembly shown in FIG. 1.
Figure 3:
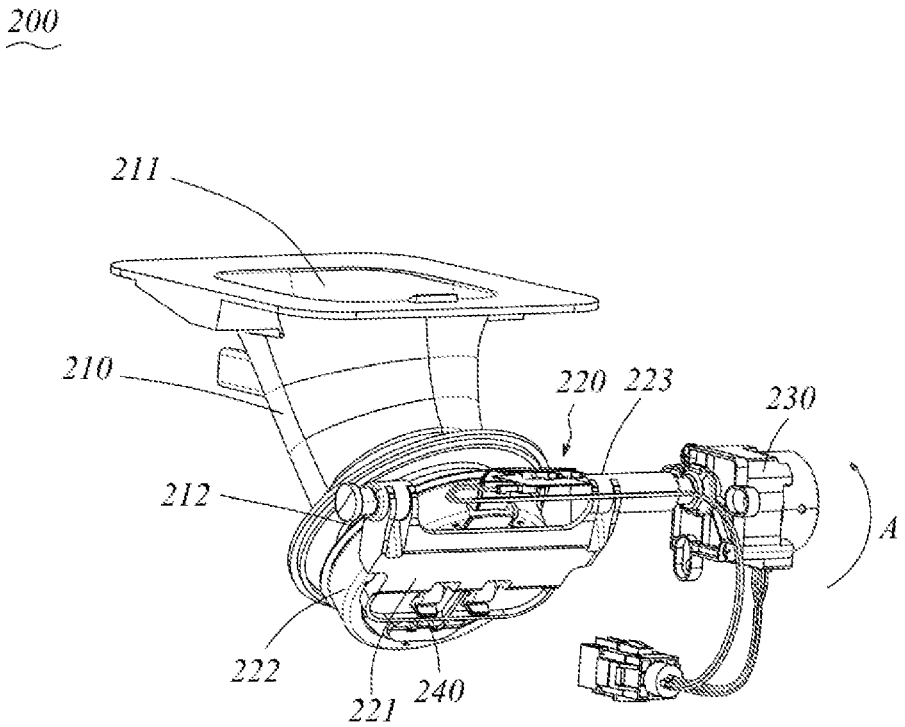
FIG. 3 is a schematic three-dimensional view of an ice dispensing device according to an embodiment of the application.

Refer to FIGS. 1 to 3, an embodiment of the present application provides a refrigerator, comprises a cabinet and a refrigerator door assembly 100 for opening and closing the cabinet. The storage chambers formed inside the cabinet comprise a refrigeration chamber and a freezer chamber. The refrigerator door assembly 100 may comprise a door 110 for opening and closing the cabinet, and the door 110 may comprise a door shell and a door liner, insulation material can be filled between the door shell and the door liner, the insulation material can be foam material, is filled. The door 110 may comprise a refrigeration door for opening and closing the refrigeration chamber and a freezer door for opening and closing the freezer chamber.

An ice-making device may be provided inside the refrigerator, and an ice-making chamber may be provided on the refrigerator's refrigeration door, the ice-making device installed inside the ice-making chamber. Additionally, an ice storage bucket and a dispenser 300 may also be provided on the refrigeration door. The ice storage bucket can be installed inside the ice-making chamber and placed under the ice-making device to receive and store ice from the ice-making device. The dispenser 300 comprises an ice dispensing device 200, the dispensing device 200 comprises an ice dispensing channel 210 that penetrates the door 110. The ice dispensing channel 210 can communicate with the ice storage bucket, allowing users to directly take out ice from the ice storage bucket through the dispenser 300 without opening the refrigerator door 110.

Alternatively, the ice-making chamber for installing the ice-making device can be provided inside the refrigeration chamber, the ice storage bucket and dispenser 300 can be provided on the refrigeration door, where ice from the ice-making device is directly discharged into the ice storage bucket on the refrigeration door and dispensed through dispenser 300. Of course, the ice-making device can also be provided inside the freezer chamber or on the freezer door, with dispenser 300 provided on the freezer door.

In an embodiment of the present application, the ice dispensing device 200 comprises an ice dispensing channel 210, the dispensing channel 210 can penetrate through the door 110. The dispensing channel 210 has an ice inlet 211 located on the side of the door liner and an ice dispensing outlet 212 located on the side of the door shell opposite the ice inlet 211. The ice inlet 211 can be connected to the ice storage bucket. At the ice dispensing outlet 212, a cover assembly 220 and a driving device 230 are provided. The cover assembly 220 can open and close the ice dispensing outlet 212, and the driving device 230 is connected to the driving shaft 223 of the cover assembly 220 to drive the rotation of the cover assembly 220. The driving device 230 can comprise a motor and transmission components and can be mounted on the sidewall of the dispenser housing 310 of the dispenser 300.

A control panel or buttons, which control the driving device 230, can be provided on the refrigerator door 110. Users can control ice dispensing through the control panel or buttons and select the amount of ice or actively control the cessation of ice dispensing when the desired amount of ice is reached.

When a user issues an ice dispensing command, the control device inside the refrigerator starts the motor of the driving device 230 to operate in a first direction A, driving the rotation of the cover assembly 220 to open the ice dispensing outlet 212. After ice dispensing is finished, the motor rotates in a second direction, to drive the cover assembly 220 to close the ice dispensing outlet 212, the second direction opposite to the first direction A.

The ice dispensing device 200 may also comprise a limit structure, the limit structure can limit the extreme open position of the cover assembly 220. When the motor rotates in the first direction A and drives the cover assembly 200 to rotate to the interference position with the limit structure, it reaches the extreme open position.

The ice dispensing device 200 may comprise an ice cube guide channel 250, the ice cube guide channel 250 can be provided on one side of the ice dispensing outlet. A dispenser recess 320 can be provided on the outside of the refrigerator door 110, the ice cube guide channel 250 located inside the dispenser recess 320. The cover assembly 200 can be placed inside the ice cube guide channel 250. Ice from the ice storage bucket is dispensed through the ice dispensing channel from the ice dispensing outlet into the ice cube guide channel 250 and then exits through the outlet of the ice cube guide channel 250. The wall of the ice cube guide channel 250 forms a limit structure, and when the cover assembly 200 rotates to the extreme open position, the cover assembly 200 interferes with the wall of the ice cube guide channel 250.

Figure 4:
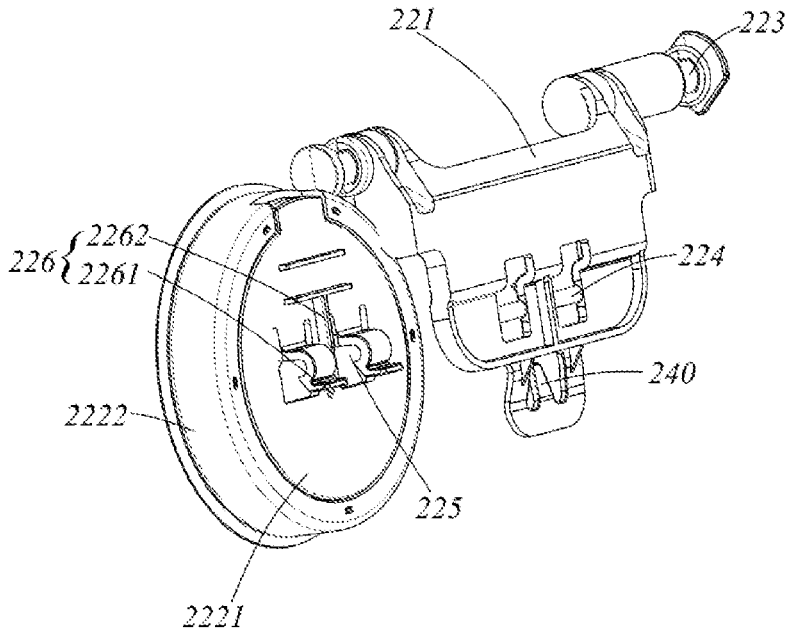
FIG. 4 is an exploded schematic view of the ice dispensing device shown in FIG. 2.
Figure 5:
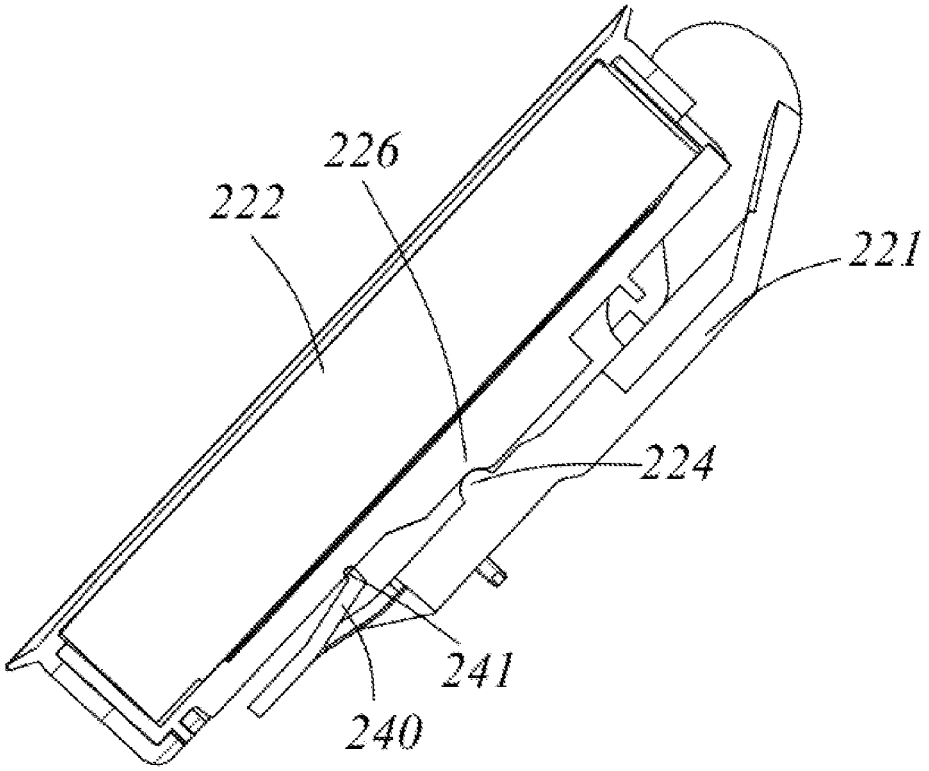
FIG. 5 is a cross-sectional schematic view of the ice dispensing device shown in FIG. 3.

Refer to FIGS. 3 to 5, the cover assembly 220 comprises a bracket 221 and a sealing cover 222, the bracket 221 and a sealing cover 222 are connected by a connecting shaft 224. The driving device 230 can be connected to the driving shaft 223 of the bracket 221, and the driving device 230 can drive the rotation of the bracket 221, thereby driving the rotation of the sealing cover 222. The connecting shaft 224 can be provided on the bracket 221, and the sealing cover 222 can be provided with a connecting hole 225 that matches the connecting shaft 224. The connecting shaft 224 and the connecting hole 225 can be a clearance fit, allowing the sealing cover 222 to swing around the axis of the connecting shaft 224. When the driving component drives the cover assembly 220 to rotate and close the ice dispensing outlet 212, if due to tolerances or some other reasons, the sealing cover 222 does not fully match the ice dispensing outlet 212 or if the sealing cover 222 is skewed relative to the ice dispensing outlet 212 causing the upper or lower side of the sealing cover 222 to contact the ice dispensing outlet 212 first, the driving device 230 drives the cover assembly 220 to rotate further. Under the action of external force, the sealing cover 222 can automatically swing slightly around the connecting shaft 224, pressing the first contacting side into the ice dispensing outlet 212, moving the sealing cover 222 to the optimal position to seal the ice dispensing outlet 212.

In this embodiment, the sealing cover 222 comprises a sealing cover plate 2221, the sealing cover plate 2221 is connected to the bracket 221. A silicone sealing element 2222 is also installed on the sealing cover plate 2221, and the space formed between the sealing cover plate 2221 and the silicone sealing element 2222 is filled with PE closed-cell foam, thus being able to block the transmission of cold air. When the sealing cover 222 closes the ice dispensing outlet 212, the edge of the ice dispensing outlet 212 presses against the surface of the silicone sealing element 2222. The surface of the silicone sealing element 2222 in contact with the ice dispensing outlet 212 can have a spherical surface, thereby enhancing the sealing effect.

An elastic support element 240 is provided between the sealing cover 222 and the bracket 221. A contact position 241 of the elastic support element 240 with the sealing cover 222 is located on the side of the sealing cover 222 that is away from the driving shaft 223, the connecting shaft 224 positioned between the driving shaft 223 and the contact position 241.

In this embodiment, the elastic support element 240 can be fixed at one end to the bracket 221 and support the sealing cover 222 at its free end. Alternatively, it can be fixed at one end to the sealing cover 222 and support the bracket 221 at its free end, or the elastic support element 240 can be connected at both ends to the sealing cover 222 and the bracket 221, respectively. Of course, other structures for mounting the elastic support element 240 between the bracket 221 and the sealing cover 222 can also be provided. a contact point of the elastic support element 240 with the sealing cover 222 can have multiple points, as long as there is a contact position 241 located on the side of the connecting shaft 224 away from the driving shaft 223.

In this embodiment, since the sealing cover 222 can swing around the connecting shaft 224 of the bracket 221, During rotation of the cover assembly 220 by the drive 230, especially when the cover assembly 220 is in the position of opening the ice dispensing outlet 212 or in the process of opening the ice dispensing outlet 212, due to the effect of gravity, the side of the sealing cover 222 away from the driving shaft 223 tends to tilt. Thus, using the elastic support element 240 to support the seal, and setting the contact position 241 of the elastic support element 240 on the side of the sealing cover 222 away from the driving shaft 223, the connecting shaft 224 positioned between the driving shaft 223 and the contact position 241, can prevent the sealing cover 222 from swinging around the connecting shaft 224 under the effect of gravity, causing the side of the sealing cover 222 away from the driving shaft 223 to tilt and consequently creating a gap between the side of the sealing cover 222 away from the driving shaft 223 and the ice dispensing outlet 212 during the process of closing the cover assembly 220.

Moreover, the elastic support element 240 is elastic, supporting the sealing cover 222 while not affecting the freedom of movement of the sealing cover 222. Therefore, the sealing cover 222 can achieve a better sealing effect.

Furthermore, in one embodiment of the present application, the center of gravity of the sealing cover 222 is located between the contact position 241 and the driving shaft 223.

In this embodiment, the connecting shaft 224 can be positioned at a location corresponding to the center of gravity of the sealing cover 222, or the connecting shaft 224 can be positioned between the center of gravity of the sealing cover 222 and the driving shaft 223. When the connecting shaft 224 is positioned between the center of gravity of the sealing cover 222 and the driving shaft 223, the contact position 241 of the elastic support element 240 with the sealing cover 222 can be set on the side of the sealing cover 222's center of gravity away from the driving shaft 223. In other words, the center of gravity of the sealing cover 222 is set between the driving shaft 223 and the contact position 241. Thus, the elastic support element 240 can better prevent the skewing of the sealing cover 222 and balance the gravity of the sealing cover 222.

Further, in one embodiment of the present application, the elastic support element 240 comprises an elastic support rib 226 located on the free end side of the bracket 221. The elastic support rib 226 can be integrally formed with the bracket 221, with its free end supporting the sealing cover 222. In this embodiment, the elastic support rib 226 extends from the free end of the bracket 221 towards the side close to the driving shaft 223. Thus, during the assembly and manufacturing process, it is only necessary to assemble the driving device 230, the bracket 221, and the sealing cover 222, and the elastic support element 240 will automatically support itself in the appropriate position without the need for manual adjustment.

Furthermore, in this embodiment of the present application, the connecting shaft 224 can be provided on the bracket 221, and the sealing cover 222 can be provided with a connecting hole 225, the connecting shaft 224 may be a clearance fit with the connecting hole 225. The connecting shaft 224 may be in point contact with the sealing cover 222. Specifically, in this embodiment, the sealing cover 222 can be provided with a support rib 226, the support rib 226 is angled relative to the connecting shaft 224. The connecting shaft 224 is supported by the support rib 226 and makes point contact between the connecting shaft 224 and the support rib 226. Of course, the connecting shaft 224 can also be provided on the sealing cover 222, the connecting hole 225 and the support rib 226 provided on the bracket 221.

In this embodiment, the support rib 226 is stepped, comprising a first support rib 2261 and a second support rib 2262, which is higher than the first support rib 2261. The connection surface between the first support rib 2261 and the second support rib 2262 is inclined, and the connection point between the first support rib 2261 and the second support rib 2262 is located at the center of the sealing cover 222. The connecting shaft 224 is supported on the first support rib 2261 and close to the connection point between the first support rib 2261 and the second support rib 2262.

Thus, the sealing cover 222 can swing in any direction around the support point of the connecting shaft 224. When the driving device 230 drives the cover assembly 220 to close the ice dispensing outlet 212, regardless of which side of the sealing cover 222 first contacts the sidewall of the ice dispensing outlet 212, it can be squeezed under external force to swing the sealing cover 222 around the support rib 226 in other directions. The sealing cover 222 can move along the axial direction of the connecting shaft 224 or swing around the support rib 226, thus completely sealing the ice dispensing outlet 212 when the cover assembly 220 is closed.

Further, in one embodiment of the present application, the connecting shaft 224 is perpendicular to the support rib 226, and the contact point between the connecting shaft 224 and the support rib 226 is located on the central axis of the sealing cover 222. This arrangement allows the sealing cover 222 to be in a more balanced position, enhancing its sealing effect.

The ice dispensing device 200 provided in this application allows the sealing cover 222 a degree of freedom. During the process of closing the ice dispensing outlet 212, the sealing cover 222 can automatically adjust its position to align with the ice dispensing outlet 212. Additionally, the presence of the elastic support element 240, which supports the sealing cover 222, prevents the sealing cover 222 from skewing under the influence of gravity, resulting in an overall effective sealing of the ice dispensing device 200.

Figure 6:
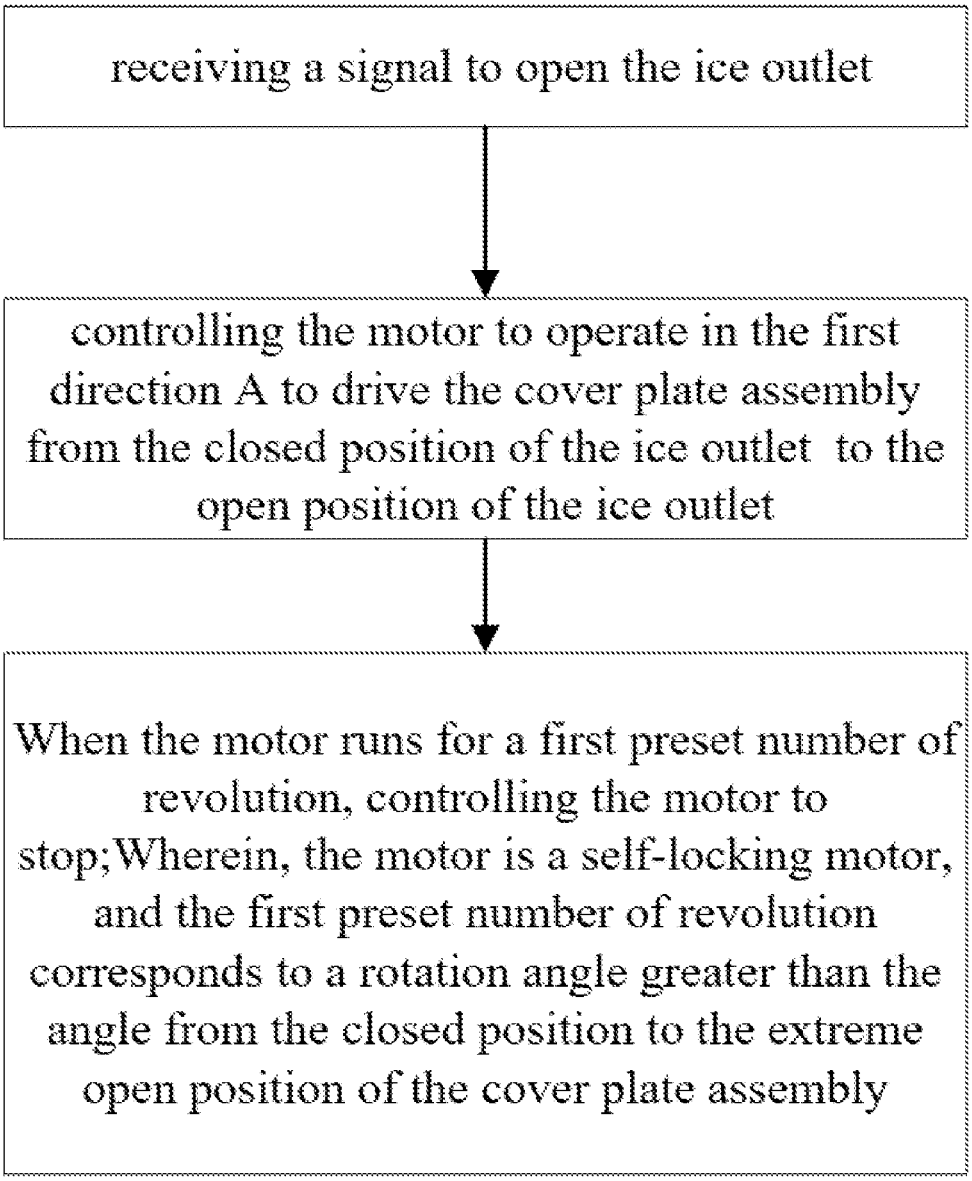
FIG. 6 is a flowchart illustrating a control method for the ice dispensing device according to an embodiment of the application.

Refer to FIGS. 3 and 6, an embodiment of the present application also provides a control method for the ice dispensing device 200, which comprises:

After receiving a signal to open the ice dispensing outlet 212, controlling the motor to operate in the first direction A to drive the cover assembly 220 from the closed position of the ice dispensing outlet 212 to the open position of the ice dispensing outlet 212;

When the motor runs for a first preset number of revolution, controlling the motor to stop;

Wherein, the motor is a self-locking motor, and the first preset number of revolution corresponds to a rotation angle greater than the angle from the closed position to the extreme open position of the cover assembly 220.

In this embodiment, when users issue an ice dispensing command through the control panel or buttons on the refrigerator door 110, it is equivalent to sending a signal to open the ice dispensing outlet 212 to the control module in the refrigerator corresponding to the ice dispensing device 200. At this point, the motor rotates to drive the cover assembly 220 to open the ice dispensing outlet 212, allowing ice cubes to slide out from the ice dispensing channel 210.

In this embodiment, the motor within the driving device 230 corresponding to the cover assembly 220 is a self-locking motor. When the motor is not powered, it has a self-locking torque that can lock the cover assembly 220 in either the closed position or the open position of the ice dispensing outlet 212. There is no need to install an elastic element on the turning axis of the cover assembly 220 to provide locking force for closing the cover assembly 220, and it also can fix the cover assembly 220 in the open position.

When the motor operates according to a predetermined program, there may be errors, and the actual rotation angle of the cover assembly 220 driven by the motor may be less than the theoretical angle. However, because the self-locking motor also possesses a critical locking torque, when the motor is powered, if the torque it experiences is less than the critical locking torque, then the motor can drive the cover assembly 220 to rotate. If the cover assembly 220 encounters interference causing the motor to stall, and if the stalling duration is long enough that the torque experienced by the motor exceeds the critical locking torque, then the motor will not continue to drive the cover assembly 220 to rotate, and the cover assembly 220 will rebound in the opposite direction.

Thus, if there are errors during the process of the motor opening the cover assembly 220, such as under-rotating by 5 turns, but no error occurs during the process of driving the cover assembly 220 to return, the cover assembly 220 may experience too long a stalling duration upon closing, causing the torque experienced by the motor to exceed the critical locking torque. This leads to the cover assembly 220 rebounding in the first direction A, creating a gap between the cover assembly 220 and the ice dispensing outlet 212.

In this embodiment, when the motor rotates in the first direction A to drive the cover assembly 220 to open the ice dispensing outlet 212, the motor operates for a first preset number of turns. The rotation angle corresponding to the first preset number of turns is the angle at which the cover assembly 220 would rotate if there were no errors during the motor's operation. The rotation angle corresponding to the first preset number of turns is greater than the angle from the closed position to the extreme open position of the cover assembly 220. This means if there were no errors during the motor operation, when the motor drives the cover assembly 220 to open in the first direction A, the motor would continue to rotate even after the cover assembly 220 has reached its extreme open position. The difference between the rotation angle corresponding to the first preset number of turns and the angle from the closed position to the extreme open position of the cover assembly 220 is within a preset range, ensuring that the torque experienced by the motor while operating for the first preset number of turns is less than the critical locking torque.

In this embodiment, the closed position of the ice dispensing outlet 212 closed by the cover assembly 220 can be the position where the cover assembly 220 contacts the ice dispensing outlet 212. However, since position of the sealing cover 222 of the cover assembly 220 in contact with the ice dispensing outlet 212 can be elastically compressed, the closed position of the ice dispensing outlet 212 closed by the cover assembly 220 can also be the position where the cover assembly 220 continues to move towards the side of the ice dispensing outlet 212 after closing the ice dispensing outlet 212 to a certain amount of elastic deformation.

Thus, even if there are errors during the motor's rotation in the first direction A, causing the actual rotation angle of the cover assembly 220 to be smaller, as long as it is within a reasonable error range, the cover assembly 220 can still move to the extreme open position, and the stall torque will not exceed the critical locking torque. This prevents the closing of the cover assembly 220 from being affected, avoiding excessive stalling during the process of the motor driving the cover assembly 220 to close the ice dispensing outlet 212, which could cause the ice dispensing outlet 212 to rebound.

Further, in one embodiment of the present application, the control method for the ice dispensing device 200 also comprises:

After receiving a signal to close the ice dispensing outlet 212, controlling the motor to operate in the second direction to drive the cover assembly 220 from the open position to the closed position;

When the motor runs for a second preset number of turns, controlling the motor to stop.

Here, the second direction is opposite to the first direction A, and the rotation angle corresponding to the second preset number of turns is greater than the angle from the extreme open position to the closed position of the cover assembly 220.

In this embodiment, when the motor rotates to drive the cover assembly 220 to open the ice dispensing outlet 212, if there are no errors, then the motor would continue to rotate when it drives the cover assembly 220 to the closed position to prevent errors during the motor-driven closing process, ensuring the cover assembly 220 fully closes. Moreover, when the motor drives the cover assembly 220 from the extreme open position to the closed position, the torque experienced by the motor while operating for the second preset number of turns is less than the critical locking torque, preventing the cover assembly 220 from rebounding.

Additionally, by eliminating errors during the motor's operation for the first preset number of steps in the process of opening and closing the cover assembly 220, it prevents the actual rotatable angle from reducing when closing the cover assembly 220. Therefore, even if the motor's rotation angle during the closing process is greater than the angle from the extreme open position to the closed position of the cover assembly 220, but while the angle is within a preset range, the duration of motor stalling will not be too long, thereby preventing the cover assembly 220 from rebounding and achieving a better sealing effect.

In this embodiment, upon receiving the signal to open the ice dispensing outlet 212, it is also possible to record the number of times and/or the duration the ice dispensing outlet 212 is open within a preset time period. Based on the number of times and/or the duration the ice dispensing outlet 212 is open within the preset time period, the startup and shutdown temperatures of the ice-making compartment's cooling system can be controlled.

When the temperature inside the ice-making compartment exceeds the cooling startup temperature, the refrigeration system is controlled to cool the ice-making compartment until its temperature decreases to the cooling shutdown temperature. Therefore, if the number of times the ice dispensing outlet 212 is opened within the preset time period exceeds a preset number and/or the duration the ice dispensing outlet 212 is open exceeds a preset duration, it can be determined that the user's demand for ice is high. At this time, a lower cooling startup temperature and a lower cooling shutdown temperature can be set for the ice-making compartment to maintain its temperature within a range below a preset temperature, or the number of ice-making cycles can be increased. Conversely, if the number of times and/or the duration the ice dispensing outlet 212 is open within the preset time period are both low, higher cooling startup and shutdown temperatures can be matched for the ice-making compartment, or the number of ice-making cycles of the ice-making device can be reduced. This allows opening data of the ice dispensing outlet 212 to be used in determining user habits and controlling the operation of the ice-making system.

Further, in one embodiment of the present application, the motor is a stepper motor, which can control the number of rotations by controlling the number of steps of the motor. The control method for the ice dispensing device 200 specifically comprises:

After receiving a signal to open the ice dispensing outlet 212, controlling the motor to operate in the first direction A for a first preset number of steps and then stopping the motor. The rotation angle corresponding to the first preset number of steps is greater than the angle required for the cover assembly 220 to rotate from the closed position of the ice dispensing outlet 212 to the extreme open position;

After receiving a signal to close the ice dispensing outlet 212, controlling the motor to operate in the second direction for a second preset number of steps and then stopping the motor. The rotation angle corresponding to the second preset number of steps is greater than the angle required for the cover assembly 220 to rotate from the extreme open position to the closed position.

In this embodiment, the stepper motor may experience step loss during operation, meaning the actual number of steps run by the motor may be less than the theoretical number of steps. Consequently, both the number of rotations of the motor and the actual rotation angle of the cover assembly 220 driven by the motor will be less than their theoretical values.

The rotation angle corresponding to the first preset number of steps is the angle at which the cover assembly 220 would rotate if there were no errors like step loss during the motor's operation. Similarly, the rotation angle corresponding to the second preset number of steps is the angle at which the cover assembly 220 would rotate if there were no errors like step loss during the motor's operation.

Thus, by controlling the operating steps of the motor, the motor can move the cover assembly 220 to the extreme open position during the opening process. This ensures that the angle at which the cover assembly 220 can move when closing does not decrease, preventing the cover assembly 220 from interfering with the ice dispensing outlet 212 and causing the motor to stall for an extended period. This would otherwise lead to the motor experiencing torque that exceeds the critical locking torque, causing the cover assembly 220 to rebound and fail to seal the ice dispensing outlet 212 effectively.

Figure 7:
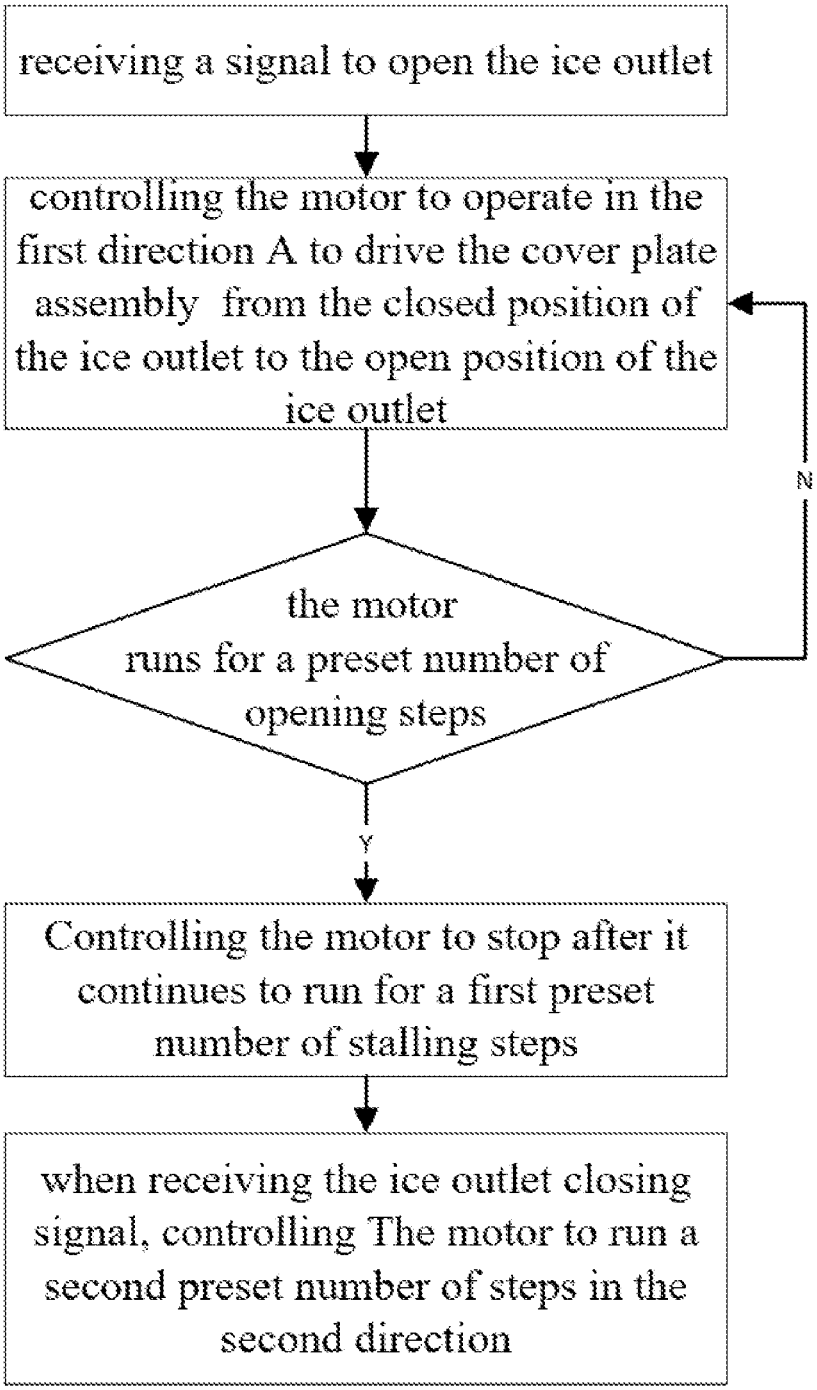
FIG. 7 is a detailed flowchart of the control method for the ice dispensing device according to an embodiment of the application.

Further, referring to FIG. 7, in one embodiment of the present application, the control method for the ice dispensing device 200 comprises the step of "controlling the motor to stop after operating in the first direction A for the first preset number of steps," which also involves:

Continuing to operate the motor in the first direction A after it runs for a preset number of opening steps;

Controlling the motor to stop after it continues to run for a first preset number of stalling steps;

Here, the first preset number of steps is the sum of the preset opening steps and the first preset stalling steps. The rotation angle corresponding to the preset opening steps equals the angle at which the cover assembly 220 rotates from the closed position of the ice dispensing outlet 212 to the extreme open position. The first preset number of stalling steps is less than 100.

In this embodiment, the rotation angle corresponding to the preset opening steps is the angle that the cover assembly 220 would rotate if there were no errors like step loss during motor operation. The preset opening steps correspond to the angle from the closed position of the ice dispensing outlet 212 to the extreme open position, ensuring that, in theory, without step loss, the motor driving the preset opening steps would move the cover assembly 220 from the closed position to the extreme open position. At this point, the motor continues for the first preset number of stalling steps, causing the cover assembly 220 to stall due to the limiting structure at the extreme open position. Actual motor operation may experience step loss, and running the first preset number of stalling steps after the preset opening steps helps mitigate the impact of step loss.

When the cover assembly 220 is at the extreme position, continuing to operate the motor in the first direction A for the first preset number of steps means the torque experienced by the motor can be less than the critical locking torque, and the first preset number of stalling steps can be less than 100. Within this step range, even if the motor stalls, it won't cause the cover assembly 220 to rebound.

Further, in this embodiment of the present application, the second preset number of steps is the sum of the preset closing steps and the second preset number of stalling steps. The preset closing steps can equal the sum of the preset opening steps, and the second preset number of stalling steps can differ from the first preset stalling steps. The rotation angle corresponding to the preset closing steps equals the angle at which the cover assembly 220 rotates from the extreme open position to the closed position, meaning that, theoretically, without step loss, running the preset closing steps moves the cover assembly 220 precisely from the extreme open position to the closed position.

For instance, if the rotation angle for the cover assembly 220 to rotate from the closed position of the ice dispensing outlet 212 to the extreme open position is 45°, the second preset number of steps could be 990 steps, the preset opening steps and the preset closing steps being 950 steps, and the second preset number of stalling steps could be 40 steps. Without step loss, running 950 steps can rotate the cover assembly 220 by 45°.

If the first preset number of stalling steps is not set during the opening process, and the motor only runs 950 steps in the first direction A, setting the number of stalling steps during closing process only, and 990 steps in the second direction for closing, step loss during opening without step loss during closing, like losing 30 steps during opening, would mean the actual number of stalling steps during the closing process would be 70 steps, possibly causing the cover assembly 220 to rebound and the ice dispensing outlet 212 to not seal properly.

However, by setting the first number of stalling steps during the motor operation in the first direction A, such as 50 stalling steps, the motor continues to run for 50 steps in the first direction A after 950 steps. Thus, even if there is step loss during the opening process, like 30 steps, the motor can still move the cover assembly 220 to the extreme open position, and the closing process of the cover assembly 220 will not be affected by any step loss during the opening process.

Figure 8:
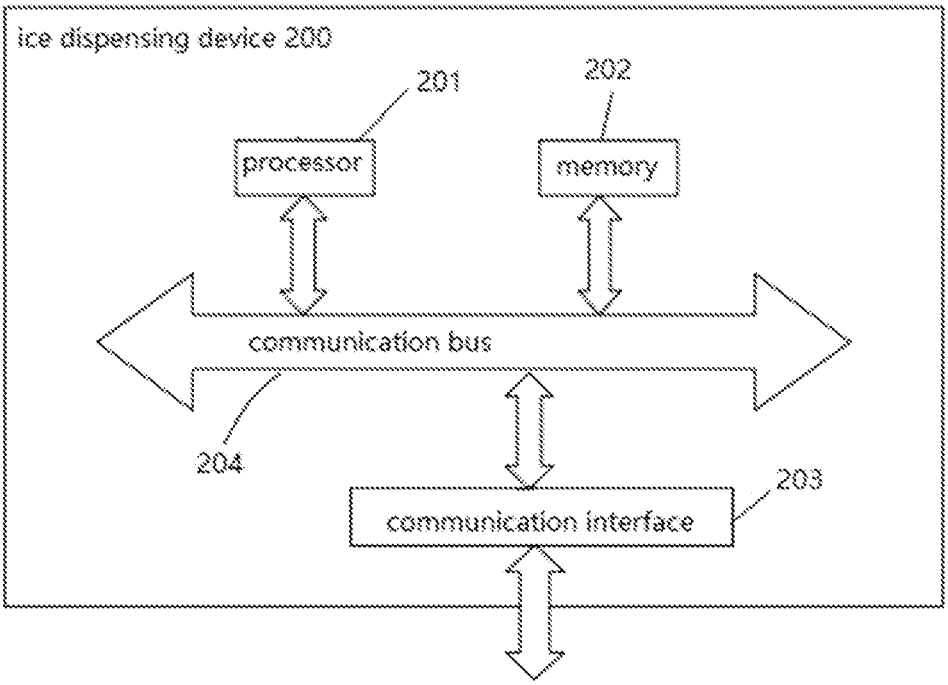
FIG. 8 is a schematic view of the ice dispensing device according to an embodiment of the application.

Referring to FIG. 8, an embodiment of the present application also provides an ice dispensing device 200, which comprises a memory 202 and a processor 201, connected via a communication bus 204. The memory 202 stores a computer program that can run on the processor 201. When the processor 201 executes the computer program, it implements the steps of the refrigerator control method described in the above embodiments. The ice dispensing device also comprises a communication interface 203 connected to the communication bus 204, for communicating with other devices of the ice dispensing device 200.

This embodiment also provides a computer-readable storage medium, on which a computer program is stored. When executed by a processor, this computer program implements the steps of the ice dispensing device control method described in the embodiments.

It should be understood that although the specification is described according to embodiments, not every embodiment contains only one independent technical solution. This narrative mode is merely for clarity. Those skilled in the art should consider the specification as a whole. The technical solutions in the various embodiments may also be appropriately combined to form other embodiments that those skilled in the art can understand.

The series of detailed descriptions listed above are only for specific illustrations of feasible embodiments of the present application and are not intended to limit the scope of the present application. Any equivalent embodiments or changes made without departing from the spirit of the present application should be comprised within the scope of the present application.

What is claimed is:

1. An ice dispensing device, comprising:

an ice dispensing channel, which has an ice dispensing outlet;

a cover assembly, for opening and closing the ice dispensing outlet; and a driving device, which connects to a driving shaft of the cover assembly to drive the rotation of the cover assembly, the driving device comprises a motor and a transmission component, wherein the cover assembly comprises a bracket and a sealing cover, wherein the bracket is connected to the sealing cover via a connecting shaft, wherein the connecting shaft is provided on the bracket, the sealing cover is provided with a connecting hole that matches the connecting shaft, the connecting shaft and the connecting hole are a clearance fit, and an elastic support element is provided between the sealing cover and the bracket, the elastic support element comprises an elastic support rib, a contact position of the elastic support element with the sealing cover is located on a side of the sealing cover that is away from the driving shaft, with the connecting shaft positioned between the driving shaft and the contact position, and wherein a center of gravity of the sealing cover is located between the contact position and the driving shaft.

2. The ice dispensing device according to claim 1, wherein the elastic support rib located on a free end side of the bracket, a free end of the elastic support rib is supported on the sealing cover.

3. The ice dispensing device according to claim 2, wherein the elastic support rib extends from the free end of the bracket towards a side close to the driving shaft.

4. The ice dispensing device according to claim 1, wherein the connecting shaft is provided on one of the bracket and the sealing cover, and the connecting shaft contacts a point on an other of the bracket and the sealing cover.

5. The ice dispensing device according to claim 4, wherein the sealing cover is capable of moving along an axial direction of the connecting shaft.

6. The ice dispensing device according to claim 4, wherein the other of the bracket and the sealing cover is provided with a support rib set at an angle to the connecting shaft, the connecting shaft is supported by the support rib.

7. The ice dispensing device according to claim 6, wherein the connecting shaft is perpendicular to the support rib, and a contact point between the connecting shaft and the support rib is located on a central axis of the sealing cover.

8. A refrigerator door assembly, comprising a door and a dispenser provided on the door, wherein the door comprises a door shell and a door liner filled with insulating material between the door shell and the door liner, the dispenser comprises the ice dispensing device according to claim 1, and the ice dispensing channel penetrates the door.

9. A refrigerator, comprising a cabinet and a door for opening and closing the cabinet, wherein an ice-making device is set inside the refrigerator, an ice storage bucket and a dispenser are set on the door, the ice storage bucket is communicated with the dispenser, the dispenser comprises the ice dispensing device according to claim 1, and the ice dispensing channel penetrates the door and communicates with the ice storage bucket.

* * * * *